US006454120B1

(12) United States Patent
Hammett

(10) Patent No.: US 6,454,120 B1
(45) Date of Patent: Sep. 24, 2002

(54) TWO LITER BOTTLE CRATE

(75) Inventor: Roy Hammett, Odessa, FL (US)

(73) Assignee: Norseman Plastics Limited, Ontario (CA)

( * ) Notice: Subject to any disclaimer, the term of this patent is extended or adjusted under 35 U.S.C. 154(b) by 0 days.

(21) Appl. No.: 09/981,363

(22) Filed: Oct. 17, 2001

(51) Int. Cl.[7] ..... B65D 21/00

(52) U.S. Cl. ..... 220/515; 220/516; 220/517; 206/203; 206/427

(58) Field of Search ..... 220/515, 516, 220/517; 206/203, 427

(56) References Cited

U.S. PATENT DOCUMENTS

| | | | | |
|---|---|---|---|---|
| 3,349,943 | A | | 10/1967 | Box |
| 3,384,261 | A | | 5/1968 | Austin |
| 3,391,814 | A | | 7/1968 | Box |
| 3,391,815 | A | | 7/1968 | Box |
| 3,416,694 | A | | 12/1968 | Bebb |
| 4,161,259 | A | | 7/1979 | Palafox |
| 4,162,738 | A | | 7/1979 | Wright |
| 4,538,742 | A | * | 9/1985 | Prodel ..... 220/515 |
| 4,700,836 | A | | 10/1987 | Hammett |
| 4,700,837 | A | | 10/1987 | Hammett |
| 4,773,554 | A | | 9/1988 | Warwick |
| D304,123 | S | | 10/1989 | Warwick |
| 4,899,874 | A | | 2/1990 | Apps et al. |
| 4,928,841 | A | | 5/1990 | Arthurs |
| 4,978,002 | A | | 12/1990 | Apps et al. |
| 5,465,843 | A | | 11/1995 | Koefelda |
| 5,529,176 | A | | 6/1996 | Apps et al. |
| 5,651,461 | A | | 7/1997 | Apps et al. |
| 5,660,279 | A | | 8/1997 | Apps et al. |
| 5,823,376 | A | | 10/1998 | McGrath |
| 6,073,793 | A | | 6/2000 | Apps et al. |
| 6,131,730 | A | | 10/2000 | Hsu |
| 6,237,758 | B1 | | 5/2001 | Hsu |

* cited by examiner

*Primary Examiner*—Steven Pollard
(74) *Attorney, Agent, or Firm*—Nixon & Vanderhye P.C.

(57) ABSTRACT

A low depth bottle crate has a peripheral wall of uniform height, the peripheral wall including a pair of side walls and a pair of end walls. A longitudinal interior partition extends between the end walls and a plurality of transverse interior partitions extend between the side walls to thereby create a plurality of bottle receiving pockets within the peripheral wall. A crate bottom is connected to the peripheral wall, an upper surface of the crate bottom formed to include a bottle supporting platform for each bottle receiving pocket. The crate interior includes a plurality of columns located at intersections of the transverse partitions and the longitudinal partition, each interior column comprised of four discrete hollow posts, each having a convex surface facing radially into one of four of the bottle receiving pockets that surround each of the interior columns.

21 Claims, 8 Drawing Sheets

TWO LITER BOTTLE CRATE

This invention relates to crate constructions for bottles and more specifically, to a crate for standard "petaloid-type" two-liter bottles.

BACKGROUND OF THE INVENTION

Low depth bottle crates are well known in the art as exemplified by U.S. Pat. Nos. 4,700,836; 4,928,841; 5,060,819; and 5,855,277. These crates typically have side and end walls that extend only about one-third the height of standard two-liter bottles. This means that, when loaded and stacked, crates rest directly on the bottles in an underlying crate. The low depth of the crate is attractive, however, since it reduces material costs, enhances visibility of the bottles, and reduces shipping space when stacked empty. Some prior crates employ crate height increasing features to provide greater support for bottles received therein, while still permitting the bottle labels to be seen. Such features may include columns that extend above the side and end walls of the crate as exemplified in U.S. Pat. Nos. 4,899,874; 4,978,002; and 5,501,352.

Low depth crates also typically have concave bottle supporting surfaces that generally conform to the shape of the bottle. The concave surfaces provide good bottle support but may result in undesirable scuffing of the bottle surface, however, particularly if dirt, sand or other debris becomes trapped between the bottle surface and the concave crate surfaces.

BRIEF SUMMARY OF THE INVENTION

The crate of this invention includes a peripheral wall of uniform height with cut-outs spaced along the side walls of the crate. The end walls of the crate are substantially cut out from the bottom of the crate upwardly to a pair of respective handles that are flush with the top of the peripheral wall and permit the crate to be grasped at opposite ends.

The interior of the crate is divided by a longitudinal center partition and three transverse partitions that together define a plurality of bottle receiving pockets, arranged in two longitudinal rows, each with four pockets. Interior bottle support columns are located along the longitudinal partition where it intersects with the transverse partitions, and in the exemplary embodiment, there are three such interior columns, one of which is located at the longitudinal and transverse center of the crate. The cut-outs in the side wall create generally, similar partial, or "half columns" in the upper portions of the peripheral wall where the transverse partitions intersect the side walls. The side wall cut-outs also partially define "quarter columns" in the corners of the crate that are also integral with the end walls. Each of the various column structures is formed to include a convex surface facing radially into each adjacent pocket. Specifically, the interior columns are each made up of four hollow posts, each post presenting a convex surface to each of four surrounding pockets; the side wall half columns are each made up of two hollow posts, each post presenting a convex surface to each of two adjacent pockets; and the corner quarter columns are each formed as essentially a single post that merges with the end wall and includes a single convex surface facing into the respective corner pockets.

The end walls of the crate are substantially cut-out in the lower portions thereof to create handle openings and respective handle bars at the opposite ends of the crate.

The crate bottom is formed with bottle support platforms for the respective bottle receiving pockets. Each bottle support in each pocket includes a relatively wide outer ring and a narrow inner or center ring that is raised relative to the outer ring. The raised center ring is adapted to project upwardly into a recess formed in the bottom of a conventional petaloid-type 2-liter bottle. Between the outer and inner rings is a recessed substantially solid annular web, with radial spokes or ribs tapering upwardly from the outer ring to the raised inner ring. The outer ring is connected to the longitudinal and adjacent transverse partitions by relatively narrow longitudinal and transverse connector webs that extend perpendicularly to the nearest partition. Along the side walls, the transverse webs terminate short of the side walls, but ribs on the webs merge with vertical ribs on the interior surfaces of the side walls. The platform outer ring, annular web, and various of the longitudinal and transverse connector webs may have drainage holes to prevent accumulation of liquid in the crate and to reduce the amount of material required for the crate.

The underside of the crate bottom is formed with recessed areas located generally centrally of the bottle support platforms, but with different outer boundaries as defined by the length and height of radially oriented ribs extending inwardly from an annular wall that defines the outer ring of the platform. For example, certain selected ribs have maximum height (i.e., they are flush with the support surfaces of the crate bottom) and extend radially inwardly from the platform annular wall to a location just inside the platform annular web. Other selected ribs terminate at the platform annular web, while others are stepped to a reduced height at a location between the platform annular wall and platform annular web. The reduced height portion of the ribs remains flush with the platform annular web. This arrangement provides extended flat recessed areas in selected directions within which respective bottle caps are free to travel.

The recessed areas are arranged in a symmetrical array about the center of the crate, i.e., the intersection of the longitudinal partition and the transverse center partition. In all cases, the recesses have flat base areas, as defined by the underside of the platform annular webs, that are larger than diameters of bottle caps that will be received therein. Those recessed areas on opposite sides of the transverse center partition are extended in the direction of the nearest end wall but not beyond the annular vertical wall of the platform. Those recessed areas that are adjacent the respective end walls are substantially completely open in the direction of the nearest end wall by reason of a reduction in the height of the platform annular wall. While a slight bump in this area remains, the reduced height facilitates dragging one filled crate off another.

Thus, the four recessed areas on one side of the transverse center partition are a mirror image of the four recesses on the other side of the transverse center partition.

Accordingly, in one aspect, the present invention relates to a low depth bottle crate having a peripheral wall of uniform height, the peripheral wall including a pair of side walls and a pair of end walls; a longitudinal interior partition extending between the end walls and a plurality of transverse interior partitions extending between the side walls to thereby create a plurality of bottle receiving pockets within the peripheral wall; a crate bottom connected to the peripheral wall, an upper surface of the crate bottom formed to include a bottle supporting platform for the bottle receiving pocket; a plurality of interior columns located at intersections of the transverse partitions and the longitudinal partition, each interior columns comprised of four discrete hollow pasts, each having a convex surface facing radially into one of four of the bottle receiving pockets that surround each of the interior columns.

In another aspect, the invention relates to a low depth crate for two-liter bottles comprising a peripheral wall including a pair of side walls and a pair of end walls; a crate bottom integrally connected to the peripheral wall; the peripheral wall having a height equal to about ½ the height of a two-liter bottle; an interior longitudinal partition and a plurality of transverse partitions defining eight bottle receiving pockets in two rows of four; three interior columns along the longitudinal partition, each interior column having four discrete posts, each having a convex surface facing into four respective surrounding bottle receiving pockets.

DETAILED DESCRIPTION OF THE INVENTION

Figure 1:
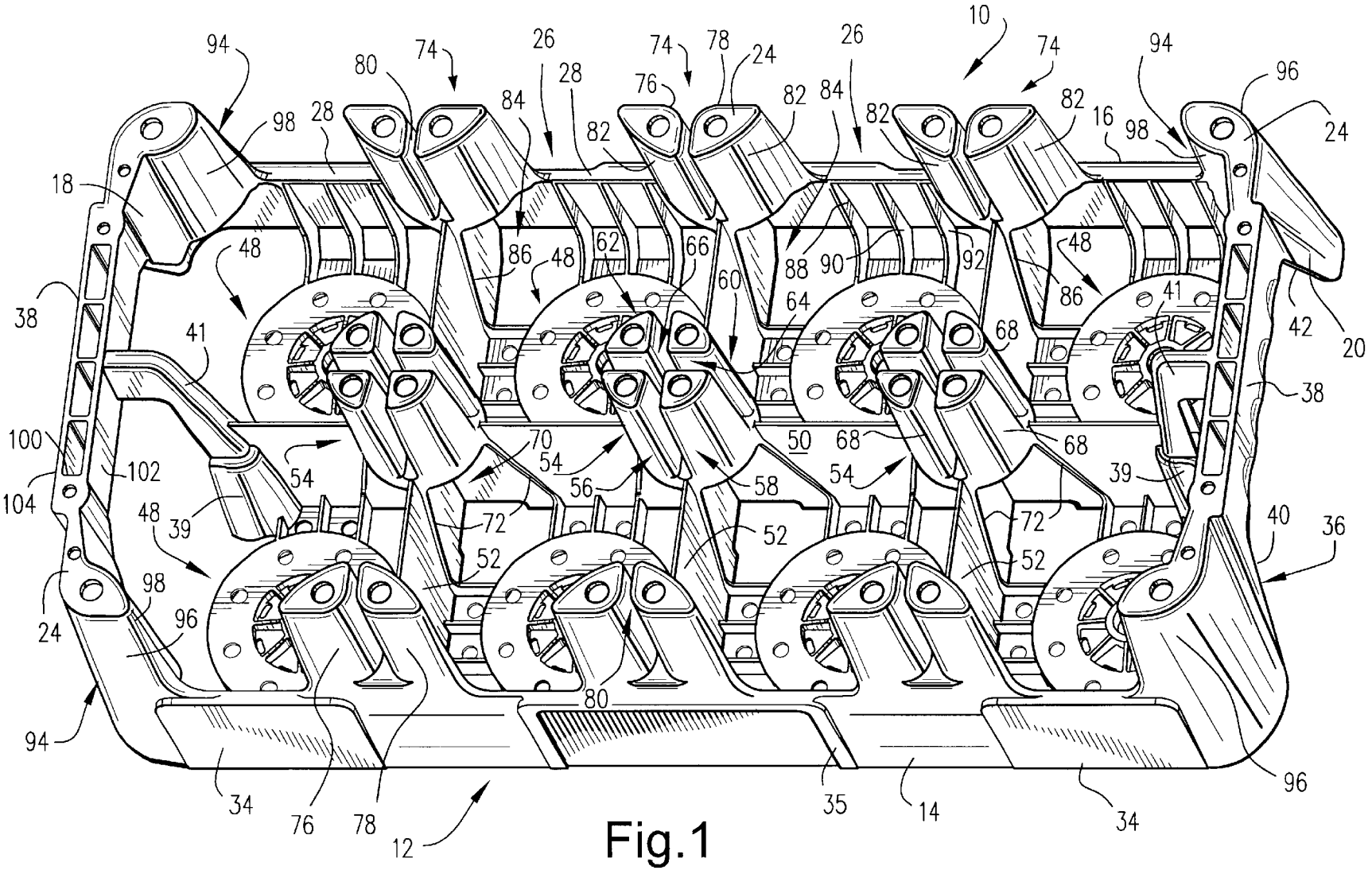
FIG. 1 is a perspective view of the two liter crate in accordance with the invention.
Figure 2:
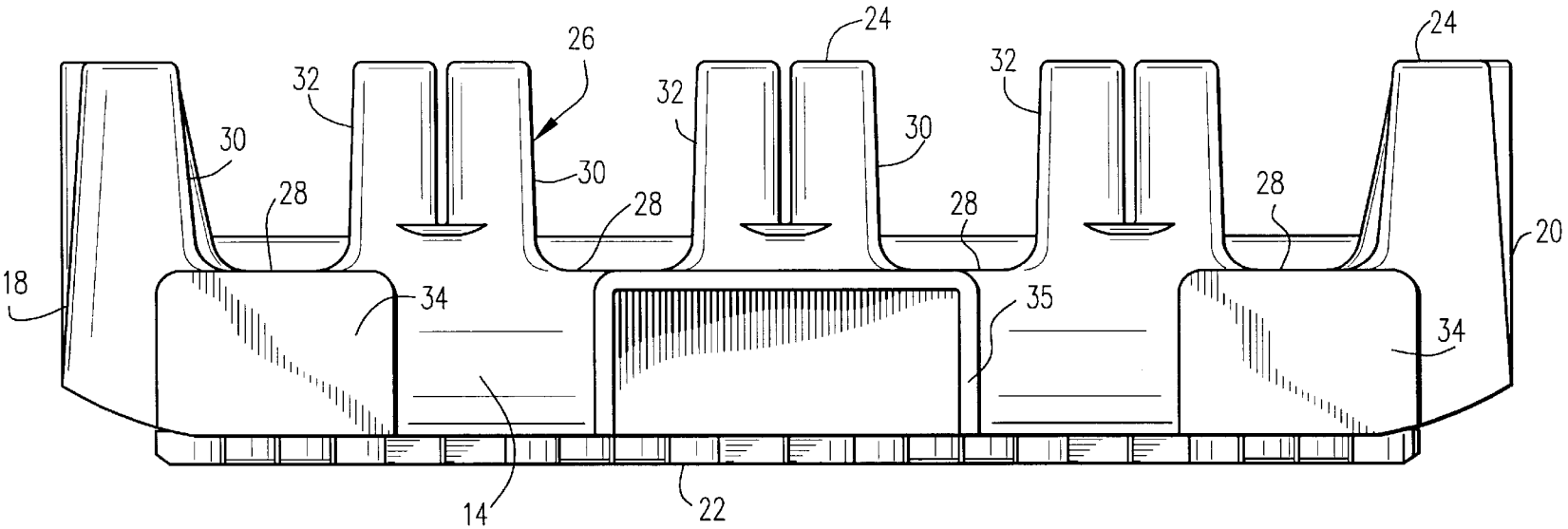
FIG. 2 is a side elevation thereof.
Figure 3:
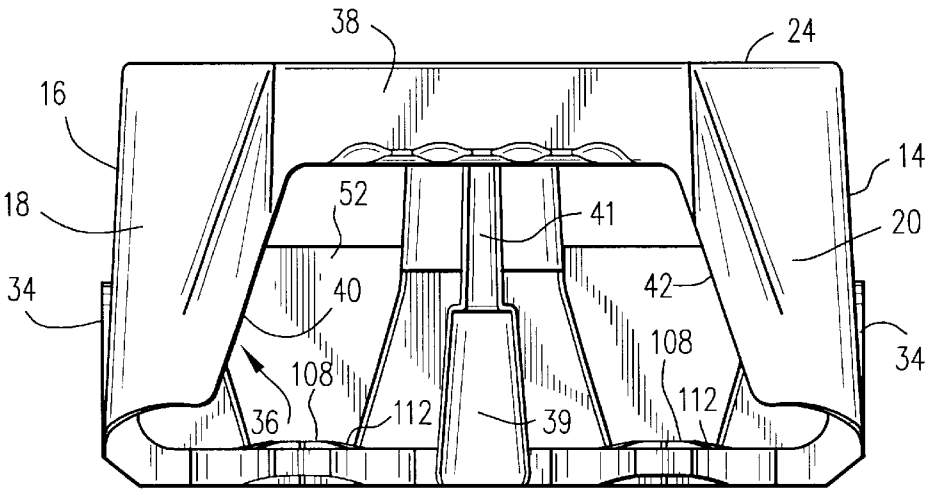
FIG. 3 is an end elevation thereof.
Figure 4:
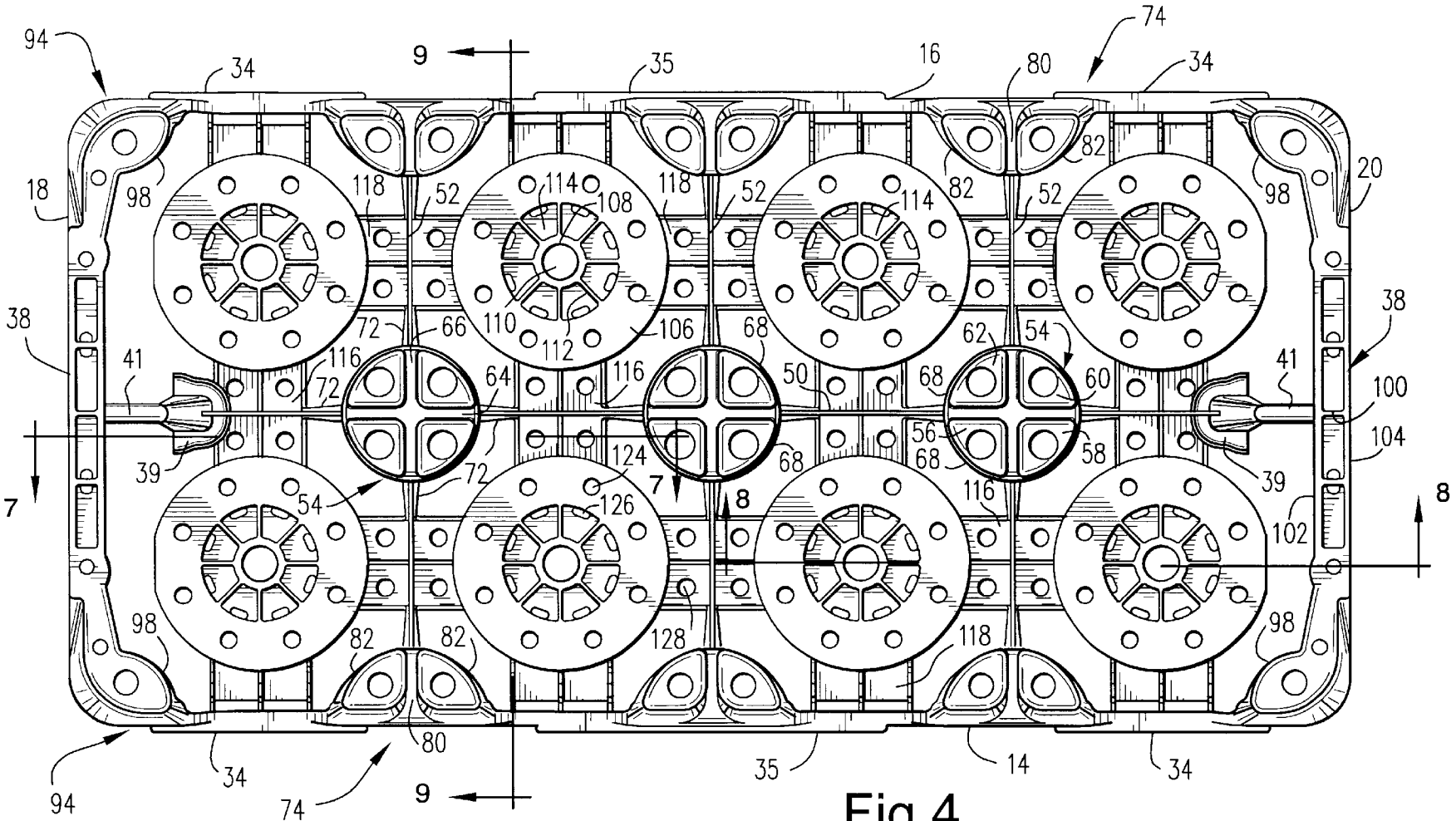
FIG. 4 is a top plan view thereof.

With reference initially to FIGS. 1–5, the crate 10 in the exemplary embodiment is preferably of one-piece molded plastic construction. The crate has a peripheral wall 12 that includes a pair of side walls 14, 16 and a pair of end walls 18, 20. The peripheral wall 12 is of uniform height, extending from a crate bottom 22 to an intermittent or discontinuous top surface 24. The latter is created by a series of U-shaped cut-outs 26 that are spaced along the side walls 14, 16 with four such cut-outs in each of the respective side walls. The cut-outs 26 reduce the weight of the crate and also provide good visibility with respect to labels on individual bottles in the crate. In this regard, the cut-outs 26 are centered on individual bottle support platforms formed in the crate bottom. Each cut-out in the side walls has a flat base 28 that merges into a pair of straight edges 30, 32 that are slightly inclined to vertical, and terminate at the discontinuous top surface 24 of the peripheral wall 12.

In the areas directly below the pair of cut-outs 26 adjacent the crate corners, thickened pads 34 are integrally formed on the exterior of the side walls 14, 16. These thickened pads, along with a thickened border 35 spanning the transverse center of the crate that may frame, for example, a customer's logo, provide additional surface area for handling by, for example, palletizing equipment, given that the upper portion of the peripheral wall 12 is slanted slightly inwardly to permit nesting of similar crates. The pads 34 and frame 35 also provide good lateral support between similar crates when stacked in multiple adjacent columns.

The end walls 18, 20 each have a centrally located trapezoidal cut-out 36 extending upwardly from the crate bottom to a handle bar 38 that is flush with top surface 24. This generally vertical cut-out 36, as defined by end wall edges 40, 42, combined with the lack of any border structure in the crate bottom along the end walls, create a relatively large handle opening that allows a user to grasp and lift the crate at opposite ends via the handle bars 38. the handle openings are nevertheless somewhat restricted in that handle bars 38 are directly connected to the crate bottom by hollow pedestals 39 and angled struts 41. The angled struts join to the inside faces of the handle bars 38, substantially mid-way along the horizontal lengths of the bars.

Figure 7:
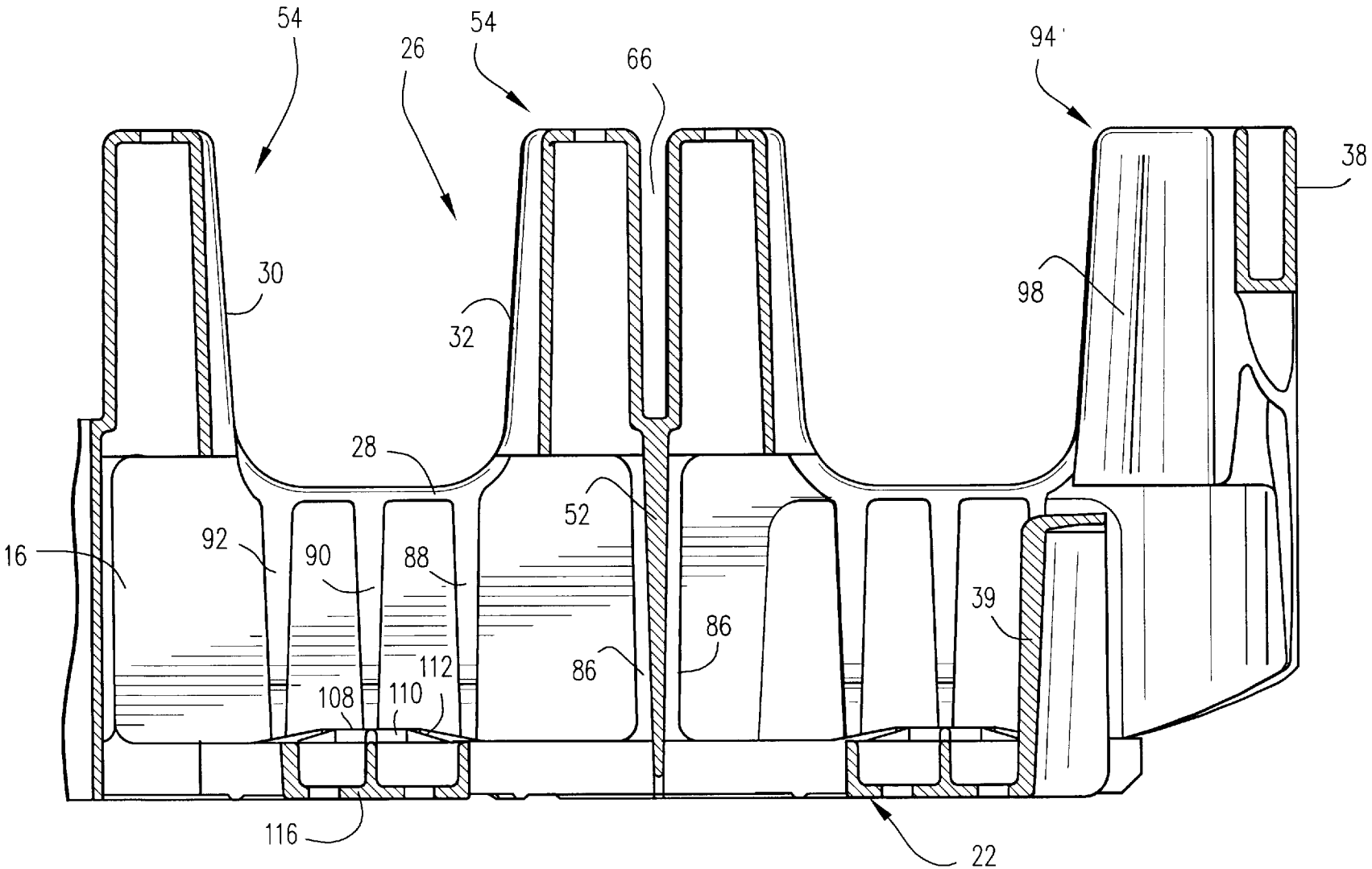
FIG. 7 is a partial section taken along the line 7—7 of FIG. 4.
Figure 8:
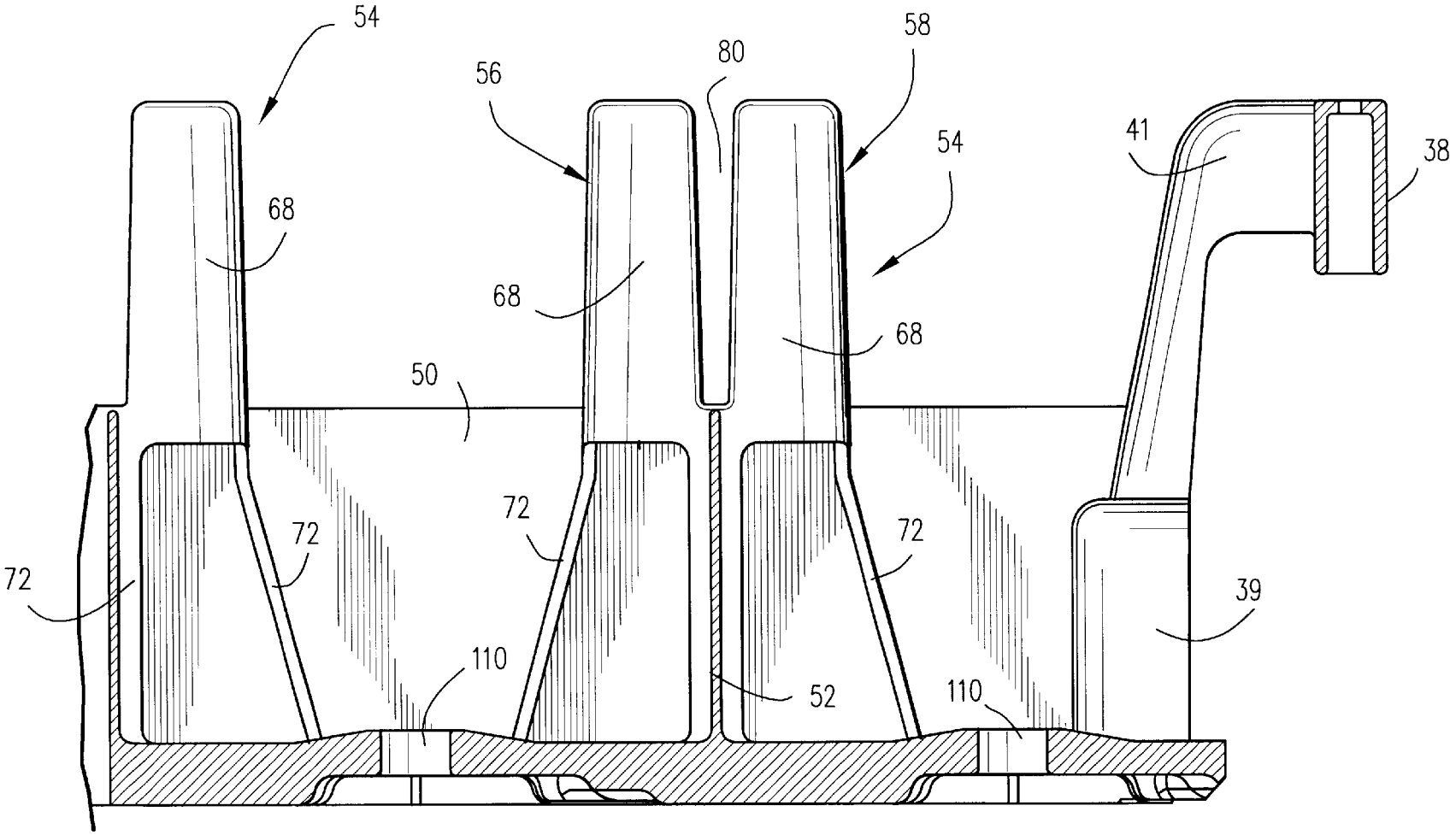
FIG. 8 is a partial section taken along the line 8—8 of FIG. 4.

The interior of the crate is divided into two rows of bottle receiving pockets 48 by a longitudinal partition 50, extending along the crate bottom 22 between end wall 18 and end wall 20 along the longitudinal center of the crate, and by three transverse partitions 52 (see also FIG. 7) extending between the side walls 14, 16, thus establishing four bottle receiving pockets 48 in each of the two rows. It will be appreciated that, except as noted herein, the bottle receiving pockets (and various other portions of the crate) are repetitive and substantially identical, and reference numerals in the drawings have been judiciously applied with this in mind, so as not to overcrowd the various figures. The middle transverse partition 52 intersects the longitudinal partition 50 at the longitudinal and transverse center of the crate (also referred to herein, simply, as the center of the crate). At each of the three interior intersections of the longitudinal partition 50 with a respective transverse partition 52, a generally circular interior column 54 is formed by four discrete, hollow posts 56, 58, 60 and 62. The four posts are separated by mutually perpendicular slots 64, 66 and thus, each post encompasses about ¼ of each column. Each post is shaped to present a convex bottle supporting surface 68 toward a respective pocket 48. The hollow posts that make up each interior column 54 are molded integrally with the upper surfaces of the longitudinal and transverse partitions, and extend only about half way toward the crate bottom. This configuration conserves material and provides openings 70 below each interior column for receiving the posts of similar interior columns in an underlying crate when a plurality of similar crates are stacked empty. In this regard, the partitions 50, 52 are received in the slots 64, 66, respectively, of the underlying crate. The interior columns 54 and partitions 50, 52 are reinforced by respective inclined ribs 72 that frame the sides of each opening 70, extending along the partitions, between the respective posts and the crate bottom.

The upper portion of the side walls 14, 16 between the cut-outs 26, are formed with respective partial or half columns 74 (approximating one half of an interior column 54) where the transverse partitions 52 intersect the side walls 14, 16. These side wall half columns 74 each include a pair of hollow posts 76, 78 separated by transverse slots 80 that are aligned with the transverse slots 66 in the interior columns, and are also adapted to receive transverse partitions 52 of an overlying crate when stacked empty. Each post 76, 78 of the half column 74 presents a convex surface 82 radially toward the respective centers of two adjacent of the bottle receiving pockets 48. These half columns are supported respectively, by the transverse partitions 52, 50 and side walls 14, 16. The half columns 74 also extend about halfway toward the crate bottom on the interior side of the side walls, with openings 84 formed therein (similar to openings 70). The half columns 74 and partitions 52 are reinforced by ribs 86 that frame one side of the openings 84. Groups of three additional reinforcing ribs or gussets 88, 90, 92 extend between the side walls and crate bottom, centrally between adjacent partial columns. The ribs 88 essentially frame the other sides of openings 84.

The corners of the crate have similar but smaller "quarter" columns 94 (approximating one quarter of an interior column 54) and include a single hollow post 96 with a convex surface 98 facing radially towards the respective centers of the corner bottle receiving pockets. The corner posts or columns 94 are integrally joined with the side and end walls and thus, do not appear as free-standing posts, but like the interior and side wall columns, extend only about half way to the crate bottom when viewed from the crate interior, thus providing nesting room for the corners of an underlying crate.

It will be appreciated that for each bottle receiving pocket 48, a bottle loaded therein will be supported by (and can only be engaged by) four convex surfaces. Because each convex surface provides only tangential contact with the oppositely curved peripheral bottle surface, friction and scuffing of the bottle is minimized.

Handle bars 38 are flush with top surface 24 and extend between portions of end walls 18, 20, between respective corner columns. The handle bars 38 are of double wall thickness, with ribs 100 extending between inner and outer handle bar surfaces 102, 104, respectively.

The crate bottom 22 is a grid-like structure integrally connected to the lower edge of the crate side walls. The interface between the crate bottom and the side walls occurs where the individual groups of three ribs 88, 90, 92 join to the side walls 12, 14 in the areas directly beneath the cut-outs 26. The transverse partitions 52 also effectively join the bottom 22 to the crate side walls 14, 16 while the longitudinal partition 50 joins the crate bottom to the handles 38 via struts 41 and pedestals 39.

Within each bottle receiving pocket 48, the crate bottom is formed to include a corresponding 2-liter bottle supporting platform designed particularly for bottles with petaloid bottoms. With reference to FIGS. 3, 4, 7 and 8, each platform includes a relatively wide and flat outer, annular ring 106 that is engaged by and supports the individual petaloid base of the bottle, while a relatively narrow, raised center (or inner) ring 108 (defining an aperture 110 concentric with a vertical center axis of the platforms 106 and pocket 48) projects into the recessed center of the petaloid base. Tapered radial ribs or spokes 112 extend along a substantially solid, recessed annular web 114 between the inner ring 108 and the outer annular ring 106. Relatively narrow webs 116, 118 extend between the outer annular ring 106 and the longitudinal and transverse partitions 50, 52, respectively. These webs are recessed relative to the outer annular ring 106 and are strengthened by respective longitudinal and transverse ribs 120, 122. Neither the webs nor the ribs are engaged by a bottle seated in the pocket. Within the outer platform ring 106, solid annular web 114, and linear webs 116, 118, drainage holes (such as those indicated at 124, 126 and 128) are provided to preclude fluid retention within the pockets (see FIGS. 4 and 5).

Figure 5:
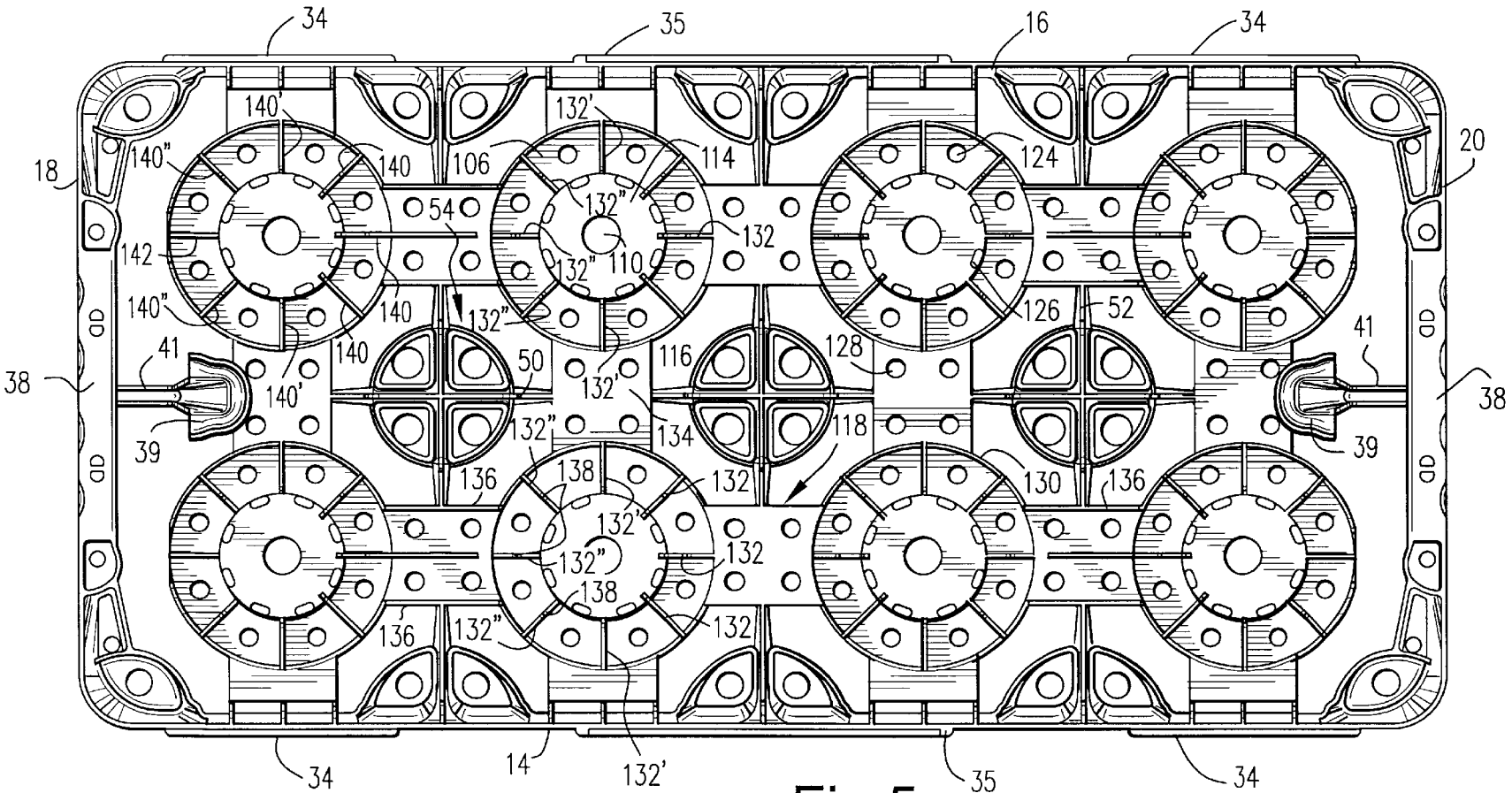
FIG. 5 is a bottom plan view thereof.
Figure 6:
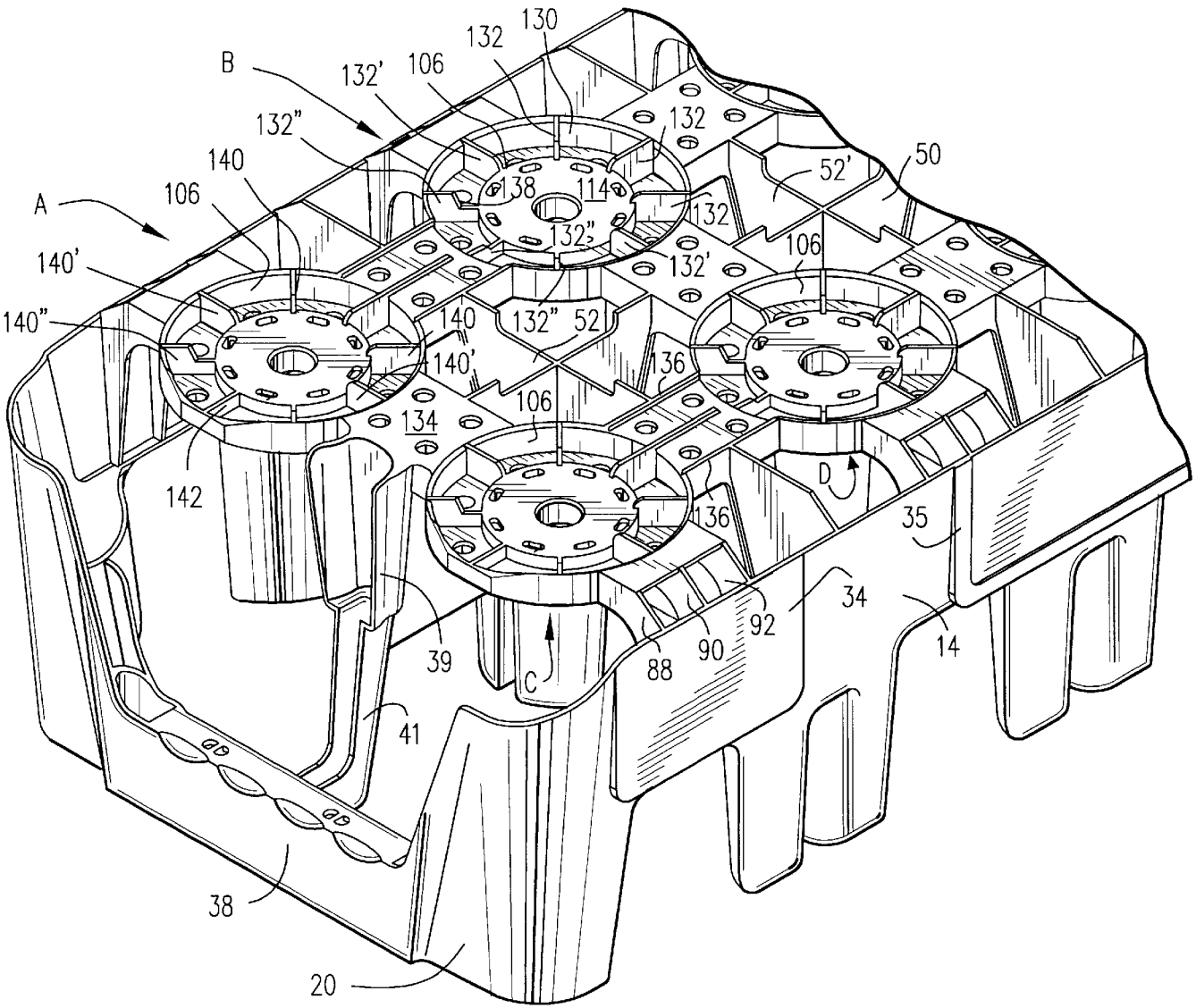
FIG. 6 is a partial perspective of the crate bottom.
Figure 9:
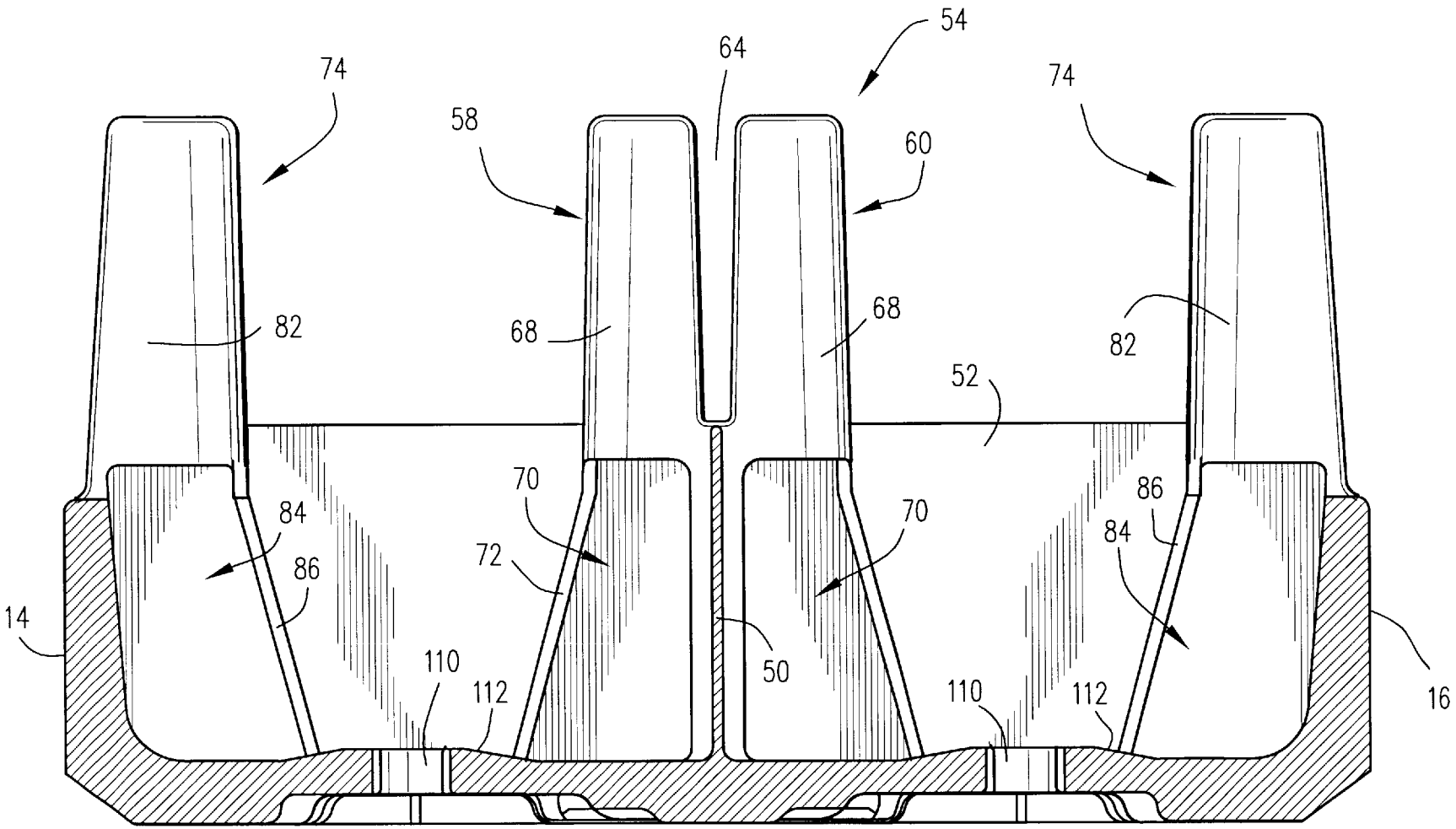
FIG. 9 is a section taken along the line 9—9 of FIG. 4.

The under surface of the crate bottom substantially mirrors the upper surface, and includes recessed areas located under the bottle support platforms. The recessed areas on one side of the transverse center partition are a mirror image of the recessed areas on the other side of the transverse center partition. With particular reference to FIG. 5 as well as FIGS. 6, 8 and 9, the individual recessed areas have outer boundaries defined by the length and height of radially oriented ribs extending inwardly from an annular wall 130 that defines the outer platform ring 106. For convenience, in FIG. 6, the undersides of the platforms have been labeled A, B, C and D. For areas B and D that are adjacent the transverse center partition 52', each of the radial ribs 132 extend radially inwardly from annular platform wall 130 to a location just inside the annular platform web 114 (recessed relative to platform wall 130) and these ribs 132 are of maximum height, i.e., they are flush with the lower edge of wall 132 and the crate support surfaces 134 (the undersides of transverse webs 116), 136 (ribs on the underside of longitudinal webs 118) and certain edge portions of the longitudinal partition 50. Ribs 132' extend only to the edge of platform 114. Selected radial ribs 132" have a reduced height commencing at shoulders 138 so that part of the ribs 132' are flush with the annular platform web 114. Ribs 132' and 132" thus expand the otherwise circular recess in areas B and D generally in a direction toward the nearest end wall. The areas A and B are also substantially identical to each other but slightly different than areas B and D. Radial ribs 140 are substantially identical to ribs 132 and ribs 140' are substantially identical to ribs 132'. Two ribs 140" are substantially identical to ribs 132", but a third rib 142 remains flush with the annular platform web 114, and annular wall 130 tapers down in an area adjacent the end wall so as to be flush with the rib 142. The recesses in the area A and C adjacent the end wall are thus extended even further, such that bottle caps of underlying bottles are free to travel to the annular wall 130 and with only slight resistance (due to the taper in wall 130) out of the area completely. This arrangement facilitates dragging one filled crate off another underlying filled crate.

It will be appreciated that since the pattern of recesses in areas in the opposite side of transverse center partition 52' are a mirror image of the areas discussed above, the net effect is to generally center one crate on another filled crate, but with enhanced ability to slide one crate off another in opposite directions, parallel to the longitudinal axis, or longitudinal partition 50.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A low depth bottle crate having a peripheral wall of uniform height, said peripheral wall including a pair of side walls and a pair of end walls; a longitudinal interior partition extending between said end walls and a plurality of transverse interior partitions extending between said side walls to thereby create a plurality of bottle receiving pockets within said peripheral wall; a crate bottom connected to said peripheral wall, an upper surface of said crate bottom formed to include a bottle supporting platform for each bottle receiving pocket; a plurality of interior columns located at intersections of said transverse partitions and said longitudinal partition, each said interior columns comprised of four discrete hollow posts, each having a convex surface facing radially into one of four of said bottle receiving pockets that surround each of said interior columns.

2. The crate of claim 1 further comprising a plurality of side wall half columns located along said side walls at intersections of said transverse partitions and said side walls, each side wall half column comprised of two discrete posts, each having a convex surface facing radially into one of two of said bottle receiving pockets adjacent each half column.

3. The crate of claim 2 wherein each corner of the crate is formed with a quarter column, each having a convex surface facing radially into one adjacent bottle receiving pocket.

4. The crate of claim 2 wherein said plurality of side wall half columns are separated by substantially U-shaped cut-outs.

5. The crate of claim 2 wherein side walls are connected to said crate bottom by a plurality of groups of ribs located along said side walls, between adjacent half columns.

6. The crate of claim 1 wherein said end walls each have an elongated cut-out area to thereby provide a handle for lifting the crate, said handle flush with said upper surface.

7. The crate of claim 6 wherein each said handle is connected to said crate bottom by means of a support strut extending between a mid-point of said handle and said crate bottom, said support strut also connected to said longitudinal interior partition.

8. The crate of claim 1 and further comprising aligned transverse slots through said side wall half columns and said interior columns to receive transverse partitions of an overlying crate when similar crates.

9. The crate of claim 8 wherein said interior columns are formed with longitudinally aligned slots to receive a longitudinal partition of any overlying crate when similar crates are stacked empty.

10. The crate of claim 1 wherein each bottle support platform includes an annular bottle support ring, and an inner ring raised relative to said bottle support ring.

11. The crate of claim 10 wherein said bottle support ring is connected to transverse and longitudinal partitions by mutually perpendicular webs.

12. The crate of claim 10 wherein each of said bottle support platforms has an aperture centered on a vertical center axis of the platform, said inner ring defining said aperture.

13. A low depth crate for two-liter bottles comprising a peripheral wall including a pair of side walls and a pair of end walls; a crate bottom integrally connected to said peripheral wall; said peripheral wall having a height equal to about ½ the height of a two-liter bottle; an interior longitudinal partition and a plurality of transverse partitions defining eight bottle receiving pockets in two rows of four; three interior columns along said longitudinal partition, each interior column having four discrete posts, each having a convex surfaces facing into four respective surrounding bottle receiving pockets.

14. The crate of claim 13 and further comprising side wall half columns along said side walls, each side wall half column centered on a respective one of said plurality of transverse partitions and extending no higher than said peripheral wall; said side wall half columns having convex surfaces facing radially into two respective adjacent bottle receiving pockets.

15. The crate of claim 14 and further comprising a quarter column in each corner of the crate, each quarter column having a convex corner surface facing radially into an adjacent bottle receiving pocket, said corner surface formed with respective third pairs of vertically oriented convex ribs.

16. The crate of claim 14 and further comprising aligned transverse slots through said side wall half columns and said interior columns and aligned longitudinal slots through said interior columns.

17. The crate of claim 14 wherein side walls are connected to said crate bottom by a plurality of groups of ribs located along said side walls, between adjacent half columns.

18. The crate of claim 13 wherein said side walls are formed with spaced cut-outs between said side wall columns.

19. The crate of claim 13 wherein none of said side wall half columns or corner columns extend above said peripheral wall.

20. The crate of claim 13 wherein none of said interior columns extend above said peripheral wall.

21. The crate of claim 20 wherein said end walls are formed with cut-outs extending upwardly from said crate bottom to a handle bar flush with said top surface.

* * * * *